US007661520B2

(12) United States Patent
Kumabe et al.

(10) Patent No.: US 7,661,520 B2
(45) Date of Patent: Feb. 16, 2010

(54) METHOD OF DETERMINING COMPLETION OF COIN INSERTION AND COIN RECOVERING DEVICE FOR AUTOMATIC VENDING MACHINE

(75) Inventors: Takashi Kumabe, Tokyo (JP); Minoru Honjo, Tokyo (JP)

(73) Assignee: Konami Digital Entertainment Co., Ltd, Tokyo (JP)

( * ) Notice: Subject to any disclaimer, the term of this patent is extended or adjusted under 35 U.S.C. 154(b) by 541 days.

(21) Appl. No.: 10/596,909

(22) PCT Filed: Dec. 27, 2004

(86) PCT No.: PCT/JP2004/019562

§ 371 (c)(1),
(2), (4) Date: Jun. 28, 2006

(87) PCT Pub. No.: WO2005/064554

PCT Pub. Date: Jul. 14, 2005

(65) Prior Publication Data

US 2007/0102259 A1 May 10, 2007

(30) Foreign Application Priority Data

Dec. 26, 2003 (JP) ..... 2003-435985

(51) Int. Cl.
*G06M 1/27* (2006.01)

(52) U.S. Cl. ..... 194/224; 194/303; 194/304; 194/306; 194/307; 194/308; 194/312; 194/346

(58) Field of Classification Search ..... 194/324, 194/240, 303, 211–213, 219, 224, 229–231, 194/239, 244–246, 302–317, 323, 342–346, 194/353; 453/2, 15, 16, 17, 20, 32, 40, 41, 453/63; 200/DIG. 3; 702/38; 324/662–669
See application file for complete search history.

(56) References Cited

U.S. PATENT DOCUMENTS 1,498,548 A 6/1924 Hughes (Continued)

FOREIGN PATENT DOCUMENTS

GB 550228 6/1941

(Continued)

*Primary Examiner*—Jeffrey A Shapiro
(74) *Attorney, Agent, or Firm*—Rankin, Hill & Clark LLP

(57) ABSTRACT

The invention provides a method of determining completion of coin insertion capable of easily and reliably determining whether or not a number of coins required for purchasing an article has been inserted. A coin holding portion (105) is constructed such that coins are retained in row in the coin holding portion (105) being electrically connected to each other in series. Further, a first electrode (121) that comes into contact with the coin located at one end side of the row is provided in the coin holding portion (105); and a second electrode (123) that comes into contact with the coin located at the other end side of the row is provided in the coin holding portion (105). The coin holding portion (105) is constructed to detect an electric current between the first electrode (121) and the second electrode (123) to determine whether or not the required number of coins has been inserted.

6 Claims, 19 Drawing Sheets

U.S. PATENT DOCUMENTS

| | | | | |
|---|---|---|---|---|
| 3,240,215 | A * | 3/1966 | Kamei | 453/58 |
| 5,433,310 | A * | 7/1995 | Bell | 194/318 |
| 5,947,257 | A * | 9/1999 | Schwartz | 194/224 |
| 2001/0023809 | A1 * | 9/2001 | Ishida et al. | 194/217 |

FOREIGN PATENT DOCUMENTS

| | | |
|---|---|---|
| JP | 10-143722 | 5/1998 |
| JP | 3057393 | 2/1999 |
| JP | 2002-092713 | 3/2002 |
| JP | 2002-133493 | 5/2002 |
| JP | 2002-279476 | 9/2002 |

* cited by examiner

METHOD OF DETERMINING COMPLETION OF COIN INSERTION AND COIN RECOVERING DEVICE FOR AUTOMATIC VENDING MACHINE

TECHNICAL FIELD

The present invention relates to a method of determining completion of coin insertion and a coin collecting device for a vending machine that can easily determine whether or not a required number of coins have been inserted into a coin collecting device used in a vending machine.

BACKGROUND ART

As the coin collecting device that collects coins for a vending machine, various arrangements have conventionally been proposed. Particularly, Japanese Utility Model Registration No. 3057393, Japanese Patent No. 3254149, Japanese Patent Laid-Open Publication No. 2002-92713, Japanese Patent Laid-Open Publication No. 2002-133493 and Japanese Patent Laid-Open Publication No. 2002-279476 respectively disclose techniques about coin collecting devices for a vending machine, which are capable of changing the number of coins required for purchasing an article.

Patent document 1: Japanese Utility Model Registration No. 3057393

Patent document 2: Japanese Patent No. 3254149

Patent document 3: Japanese Patent Laid-Open Publication No. 2002-92713

Patent document 4: Japanese Patent Laid-Open Publication No. 2002-133493

Patent document 5: Japanese Patent Laid-Open Publication No. 2002-279476

DISCLOSURE OF THE INVENTION

Problem to be Solved by the Invention

The respective arrangements of the conventionally proposed coin collecting devices have advantages and disadvantages. For example, some have such a problem that the construction is simple but coins are not collected reliably; others have such a problem that coins are reliably collected but the construction is extremely complicated. Also, some of the conventional coin collecting devices are very complicated in order to have article dispensing operation and coin collecting operation work in concert with each other. Further, in some of the conventional devices, it is very complicated to set the number of coins required for purchasing an article.

An object of the present invention is to provide a method of determining completion of coin insertion and a coin collecting device for a vending machine that can easily and reliably determine completion of insertion of coins required for purchasing an article.

Another object of the present invention is to provide a method of determining completion of coin insertion and a coin collecting device for a vending machine that can distinguish a forged coin.

A further object of the present invention is to provide a method of determining completion of coin insertion and a coin collecting device for a vending machine that can easily change the number of coins to be inserted.

Yet anther object of the present invention is to provide a coin collecting device for a vending machine that can reliably collect and reset the coins.

Means for Solving the Problem

The present invention is directed to a method of determining completion of coin insertion to determine whether or not a required number of coins have been inserted into a coin holding portion of a coin path in a coin collecting device for a vending machine, and a device that implements the method. The required number of coins for purchasing an article are held in a row in the coin holding portion.

In the present invention, the coin holding portion is constructed to have the coins, which are held therein in a row, electrically connected to each other in series. Further, the coin holding portion is provided with a first electrode that comes into contact with the coin located at one end of the row of the coins. The coin holding portion is also provided with a second electrode that comes into contact with the coin located at the other end of the row of the coins. Completion of insertion of the required number of coins is determined based on whether or not an electric current flows between the first and second electrodes.

In the present invention, unless the required number of coins are held or aligned in the coin holding portion, the electric current does not flow between the first second electrodes via the coins. Therefore, it can be easily and reliably determined whether or not insertion of the required number of coins for purchasing an article is completed. Particularly, if a non-metal forged coin is included in the inserted coins, the method of the present invention can also determine whether or not a forged coin is inserted since the electric current does not flow. Also, in the case where a metal forged coin is inserted, if the resistance value of the forged coin is different from that of the genuine coin, the value of the electric current, which flows between the first second electrodes (or the entire resistance value), varies. Therefore, it is possible to determine whether or not a forged metal coin is included in the inserted coins by measuring the current value (resistance value).

The total of the required number of coins can be changed by changing an installation position of at least one of the first and second electrodes.

Specifically, a coin collecting device for a vending machine that implements the method of the present invention includes a collecting device body, a coin-insertion completion determining means and a coin collecting mechanism. The collecting device body includes a coin path having a coin holding portion disposed therein that holds or retains the required number of coins for purchasing an article. The coin-insertion completion determining means determines whether or not the required number of coins have been inserted into the coin holding portion. The coin collecting mechanism operates in concert with the dispensing operation of an article to move the coins from the coin holding portion into a coin box. In the coin collecting device of the present invention, the coin holding portion is constructed so that the coins, which are held in the coin holding portion in a row, are electrically connected in series. The coin-insertion completion determining means includes a first electrode that comes into contact with the coin located at one end of the row of the coins and a second electrode that comes into contact with the coin located at the other end of the row of the coins. The coin-insertion completion determining means is constructed so that an electric current flows between the first second electrodes to detect that the required number of coins have been inserted. Further, the required number of coins can be changed by arranging the installation position of at least one of the first and second electrodes to be changeable.

BEST MODE FOR IMPLEMENTING THE INVENTION

Figure 1:
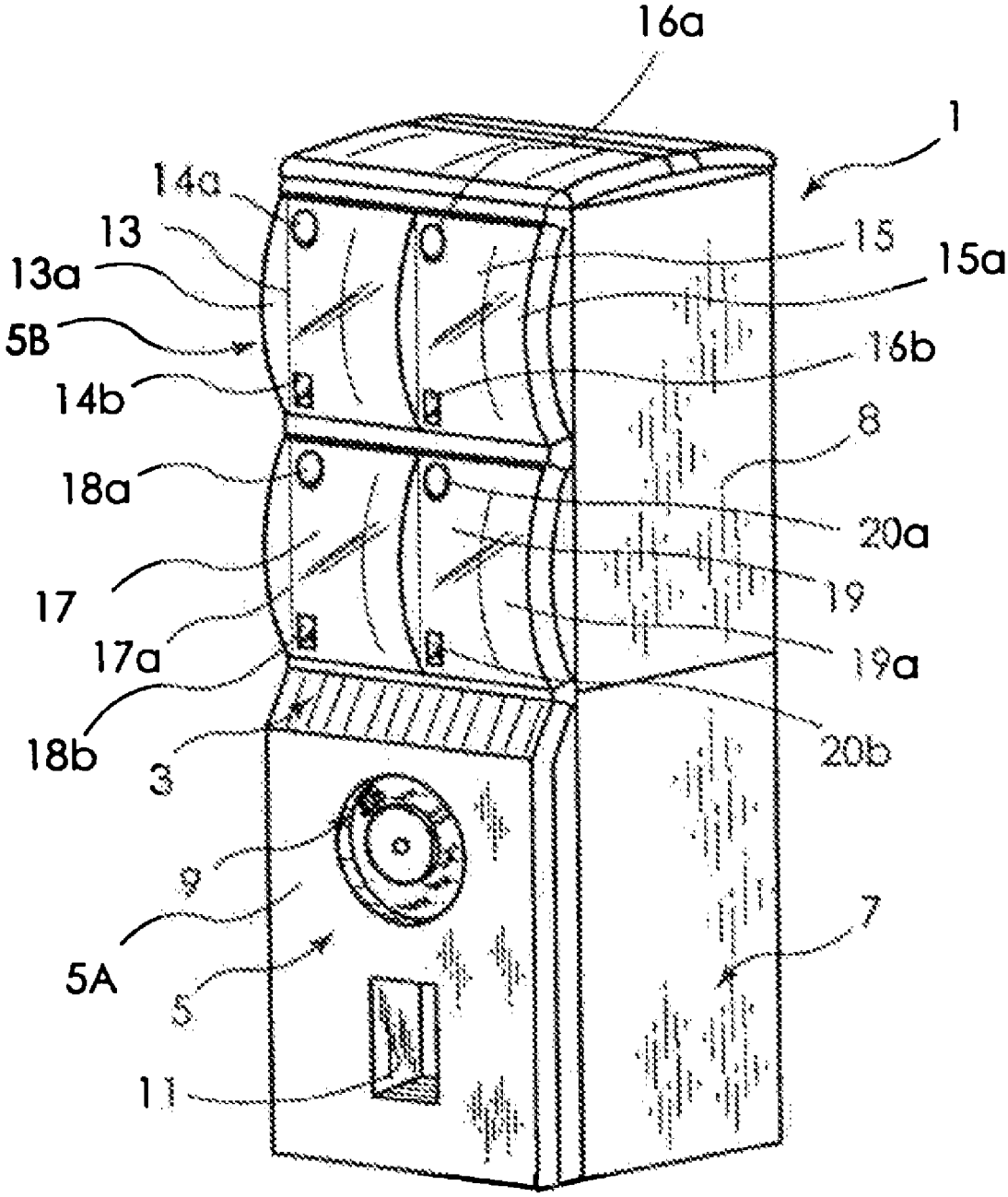
FIG. 1 is a perspective view of a vending machine according to one embodiment of this invention.
Figure 2:
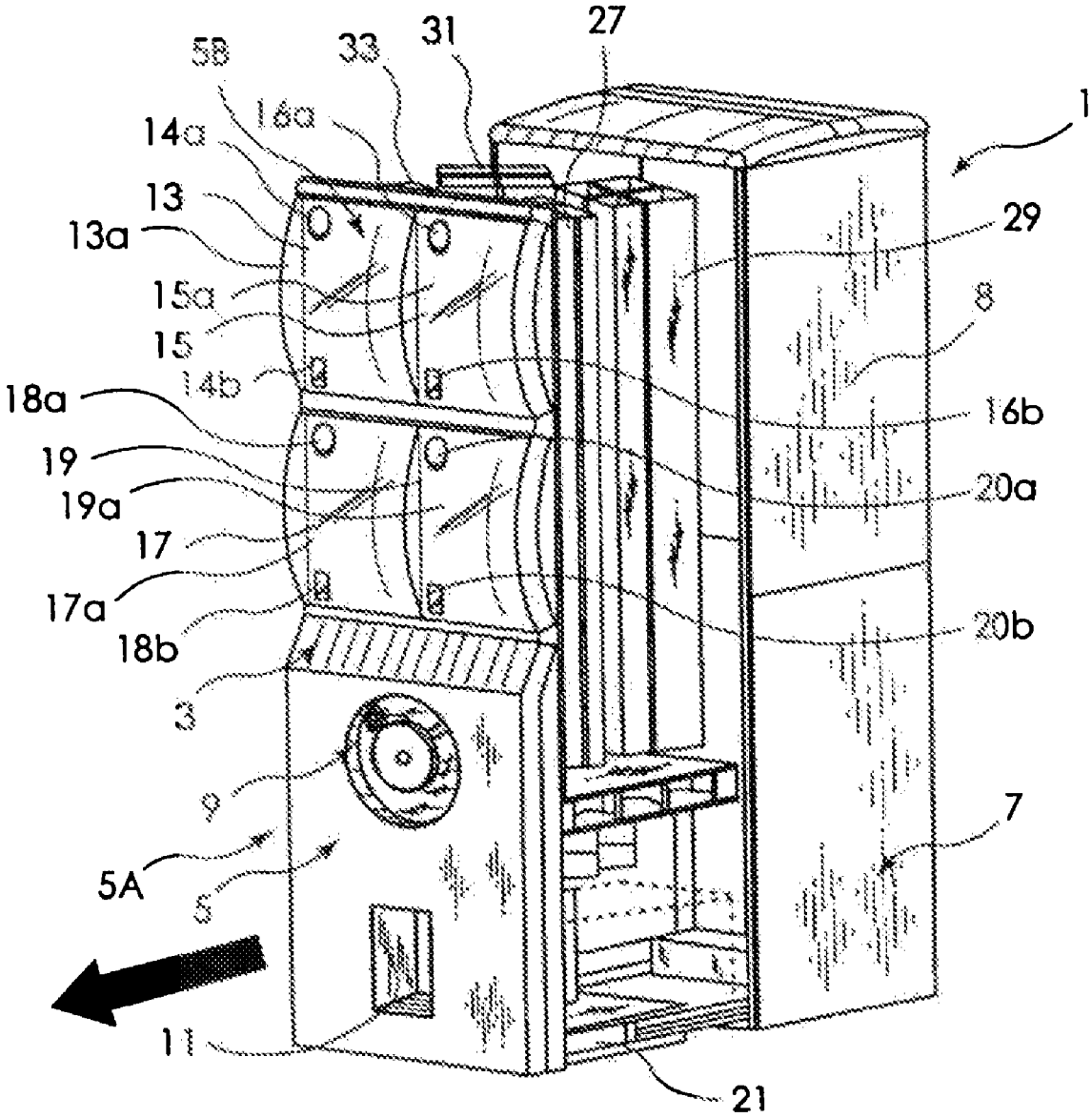
FIG. 2 is a perspective view showing a front panel drawn out forward from a case body.

One embodiment of a vending machine according to the present invention will be described in detail by referring to the accompanying drawings. FIG. 1 is a perspective view of one embodiment of the vending machine according to this invention. The vending machine 1 comprises a storage case 3 including a front panel 5 and a case body 7. The front panel 5 is constructed to be removable from the case body 7. FIG. 2 shows the front panel 5 drawn out forward from the case body 7. In FIG. 2, only a part 21 of a frame mounted onto the back of the front panel 5 is shown. A front portion of the front panel 5 comprises a lower half portion 5A and an upper half portion 5B. The lower half portion 5A has a manual operation means 9, provided commonly for four article stockers, and an article dispensing opening 11. The upper half portion 5B is provided with four coin collecting device containers 13-19 where four coin collecting devices corresponding to the four article stockers 27-33, which will be described in detail later, are installed. The coin collecting device containers 13-19 have transparent covers 13*a*-19*a*, through which an inner display portion can be seen. The covers 13*a*-19*a* are provided respectively with four coin slots 14*a*, 16*a*, 18*a*, 20*a* associated respectively with the four coin collecting device containers 13-19. The covers 13*a*-19*a* are also provided with returned coin pickup openings 14*b*, 16*b*, 18*b*, 20*b*, to which coins are returned by a cancel or reset operation.

Figure 3:
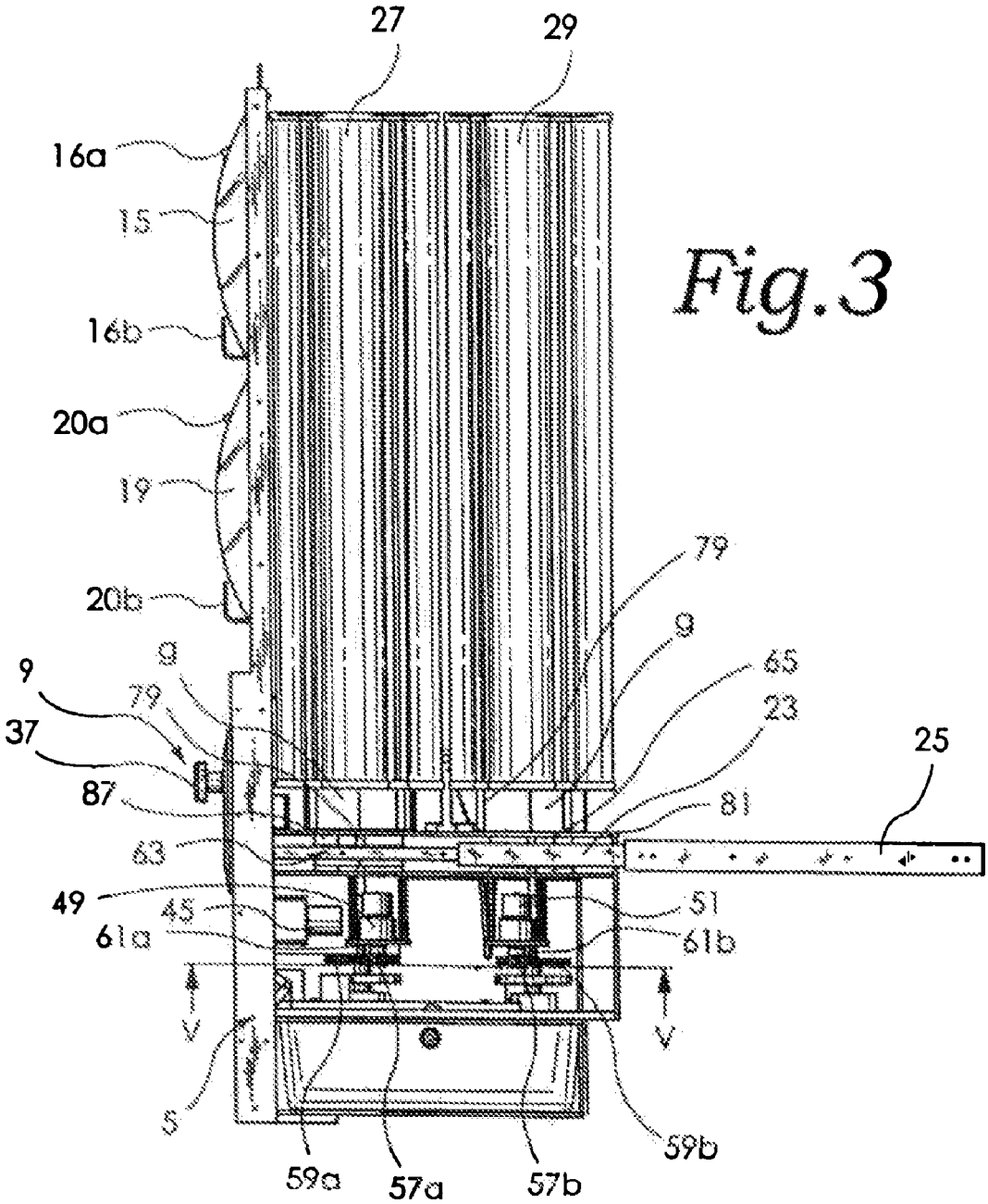
FIG. 3 is a detailed view showing the front panel drawn out forward from the case body.

As detailed in FIG. 3, a part 23 of the frame is mounted onto the back of the front panel 5. The article stockers 27-33, which will be described later, a guide path, a drive force generation/transmission mechanisms and article moving mechanisms are installed in the frame. The frame as a whole is constructed to have an enough mechanical strength to support the article stockers, guide path, drive force generation/transmission mechanisms and article moving mechanisms. FIG. 3 shows a slide frame 23 used to draw out the front panel 5 forward to the front. FIG. 3 also shows another frame 25 behind the frame 23, which is a rail frame constituting a frame holding structure mounted onto the case body 7. In FIG. 3, the lower frame 21 that is shown in FIG. 2 is omitted. If the frame 23 and the frame 25 have sufficient mechanical strength, the lower frame 21 shown in FIG. 2 is not necessary. This arrangement facilitates maintenance and inspection works because virtually the whole inner drive construction comes out when the front panel 5 is drawn out forward. In addition, additional articles can be replenished easily to the article stockers 27-33.

In the upper half portion of the storage case 3, side walls 8 of the storage case 3 are constituted by a transparent or translucent material so that main portions of the article stockers 27-33 described later can be seen from outside the storage case 3. Further, the main portions of the article stockers 27-33 are also constituted by a transparent or translucent material. With this arrangement, the article stockers 27-33 can be seen from the outside, thereby allowing the remaining articles to be checked. Thus, the timing for replenishment of the articles can easily be determined. This arrangement, namely, allowing the articles to be seen from the outside, also motivates the consumers to buy them.

Figure 4:
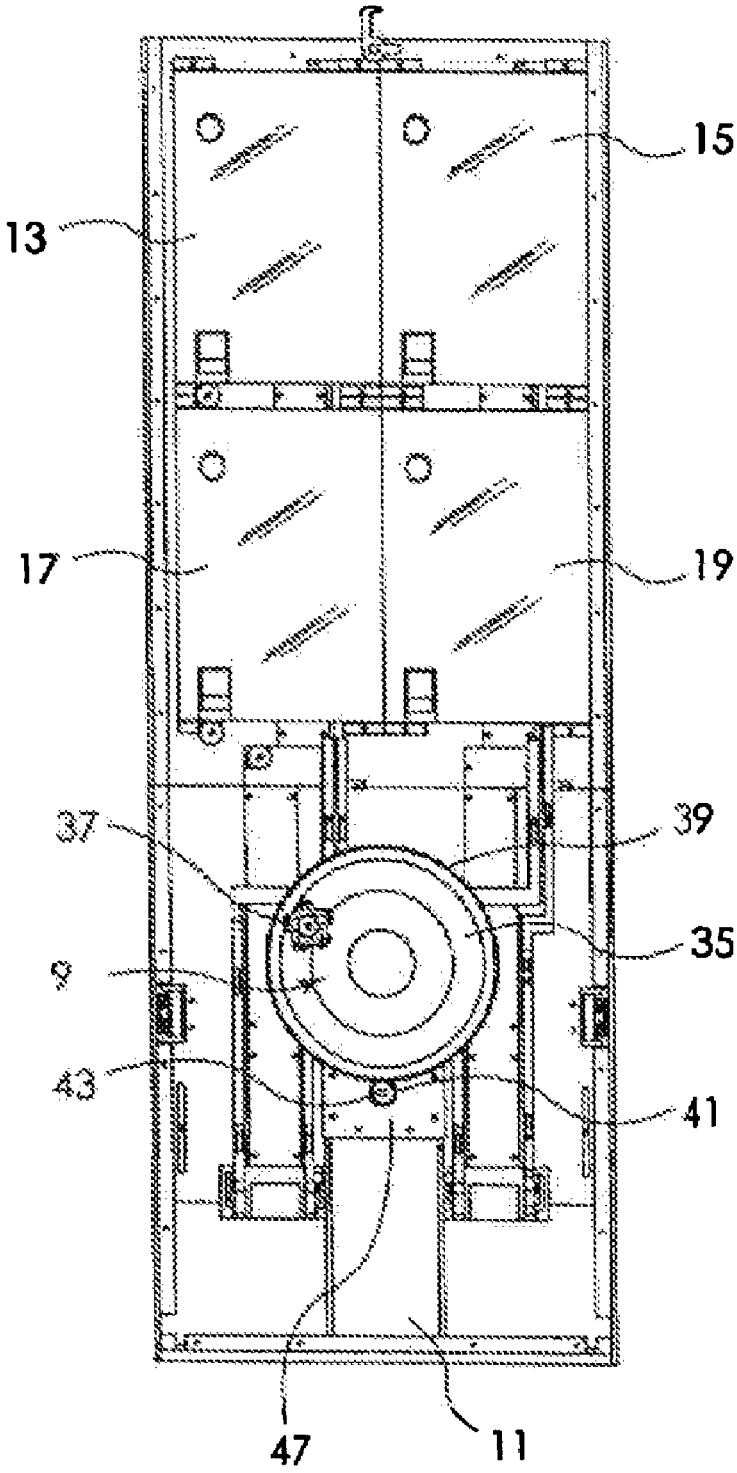
FIG. 4 is a front view of the vending machine with a panel portion of the front panel removed.
Figure 5:
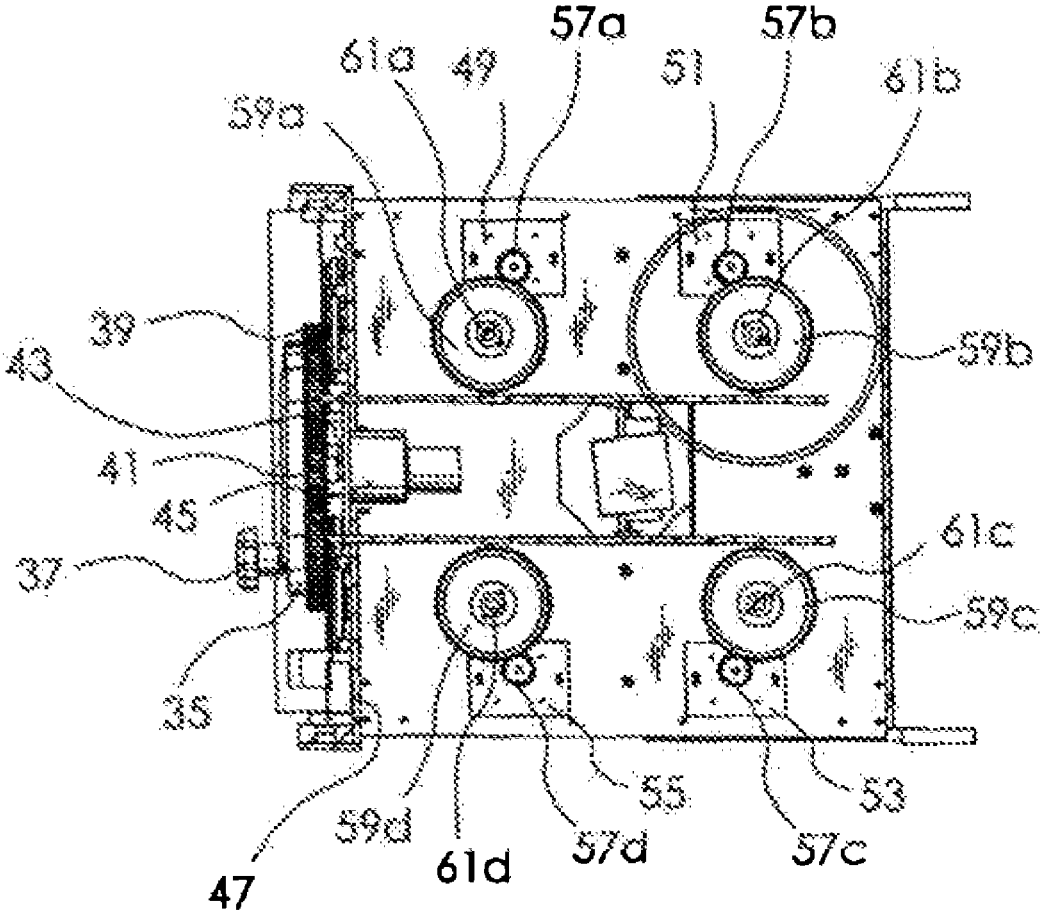
FIG. 5 is a cross-sectional view taken along the line A-A of FIG. 3.
Figure 6:
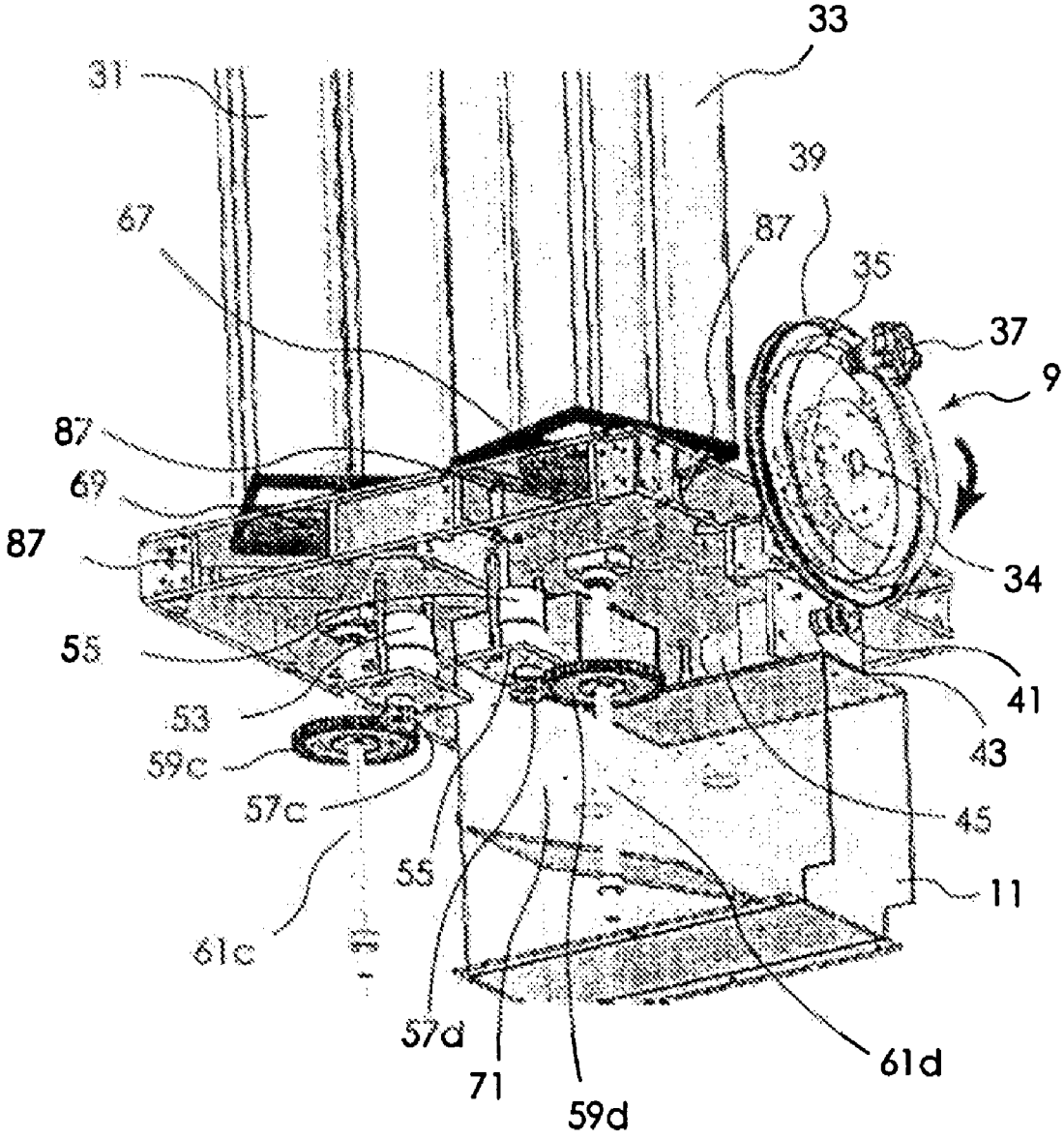
FIG. 6 is a perspective view of an inner mechanism as seen from diagonally below.

The manual operation means 9 may simply be anything can apply a drive force by the manual operation. In this example, a rotary operation means is employed. FIG. 4 shows a front view of the vending machine with the panel portion of the front panel 5 removed from the view. FIG. 5 shows a cross-sectional view taken along the line A-A of FIG. 3. FIG. 6 shows a perspective view of an inner mechanism as seen from diagonally below. As shown in FIG. 5 and FIG. 6, the manual operation means 9 includes a disk-like rotary member 35 that rotates about a rotating shaft 34 (FIG. 6), and a knob-like handle 37 rotatably arranged relative to the rotary member 35. Behind the disk-shaped rotary member 35, a circular gear 39 is arranged. Below the rotary member 35, a small gear 41 is arranged, being in mesh with the gear 39. A shaft 43 of the small gear 41 is directly coupled with a rotating shaft of a rotary generator 45, as shown in FIG. 5.

The generator 45 is mounted onto a front side frame member 47. As shown in FIG. 3, FIG. 5 and FIG. 6, electricity produced by the generator 45 is supplied as power source to four motors 49, 51, 53, 55. As the generator 45 starts power generation, the electricity generated by the generator 45 is selectively supplied to the motors through a control circuit. Output shafts of the motors 49-55 are provided with small-diameter gears 57*a*-57*d* that constitute a part of a decelerating mechanism. These small gears 57*a*-57*d* are in mesh with large-diameter gears 59*a*-59*d* that constitute a part of the decelerating mechanism. The gears 59*a*-59*d* are respectively supported on rotating shafts 61*a*-61*d*. The rotating shafts 61*a*-61*d* respectively constitute drive shafts of the article moving mechanisms 63, 65 (FIG. 3), 67, 69 (FIG. 6) that act to rotate the article stockers 27-33.

In this embodiment, the gear 39 and the small gear 41 jointly constitute an accelerating mechanism that causes the rotating shaft of the generator 45 to rotate at a higher speed than that of the rotary member 35 as the rotary member 35 is turned. The accelerating mechanisms 39, 41, the generator 45, the motors 49-55, the gears 57*a*-57*d* and the gears 59*a*-

59*d* jointly constitute a drive force generation/transmission mechanism which utilizes a force applied from the manual operation means 9 to generate a drive force and transmits the drive force to the article moving mechanisms 63, 65, 67, 69.

Next, by referring mainly to FIG. 7 to FIG. 10, the arrangements of the article stockers 27-33 and the article moving mechanisms 63, 65, 67, 69 that move one of a plurality of articles stored in the article stockers 27-33 into one guide path 71 will be described below. As typically shown in FIG. 8, each of the article stockers 27-33 includes four article receiving paths 73*a*-73*d* in each of which a plurality of articles are vertically stacked one upon another. The four article receiving paths 73*a*-73*d* are arranged to surround a vertically extending center line 77. More specifically, the four article receiving paths 73*a*-73*d* surround the vertically extending center line 77, and separation walls 79*a*-79*d* are provided to separate two adjoining article receiving paths among the article receiving paths, and adapted to extend radially from the center line 77 at an angular interval of 90 degrees (=360°/4). When the number of article receiving paths is m, the separation walls may be arranged at an angular interval of 360°/m (m is a positive integer of two or more). The article receiving paths 73*a*-73*d* have their upper and lower ends open. As shown in FIG. 3, between the lower ends of the article receiving paths 73*a*-73*d* and an upper partition wall 81 described later, there is a gap g, in which the lower ends of the separation walls 79*a*-79*d* are exposed. The center line 77 coincides with the axis of the rotating shaft 61*d*.

The relation among the article stockers 27-33, the upper partition wall 81 and an upper through-hole 85 formed in the upper partition wall 81 are described as follows: the weight of the articles received in the article receiving paths 73*a*-73*d* is entirely supported by the upper partition wall 81 until article passes through the upper through-hole 85 and falls onto a lower partition wall 83. In this arrangement, all the weight of the articles in the article receiving paths is supported by the upper partition wall 81. Thus, the rotating shafts 61*a*-61*d* can be prevented from being subjected to an excessive force. Further, since the weight of the articles situated above an article being moved is borne by the upper partition wall 81, the article that has landed on the lower partition wall 83 is prevented from being subjected to excessive force and thus can be placed smoothly into the guide path.

Each of the article moving mechanisms 63, 65, 67, 69 (FIG. 3, FIG. 6) may include a first moving mechanism and a second moving mechanism. The first moving mechanism moves articles sequentially from the four article receiving paths 73*a*-73*d* to a predetermined position as the rotating shafts 61*a*-61*d* are rotated by the associated motors 49-55. The second moving mechanism moves the article, which has been moved to the predetermined position by the rotation of the rotating shafts 61*a*-61*d*, into the guide path 71.

In this example, as the first moving mechanism for the article moving mechanisms 63, 65, 67, 69, a free fall type moving mechanism is used. More specifically, the first moving mechanism comprises the upper partition wall 81 and the lower partition wall 83 that are disposed below the article stockers 27-33, vertically spaced from each other and extend perpendicular to the rotating shafts 61*a*-61*d*. The first moving mechanism also comprises those portions of the separation walls 79*a*-79*d* that are exposed in the gap g. The upper partition wall 81 is formed with the upper through-hole 85 through which one article is allowed to fall from one of the article receiving paths onto the lower partition wall 83 while the article stockers 27-33 are rotating about the rotating shafts 61*a*-61*d*. The shape and position of the upper through-hole 85 are determined so that, when the rotating shafts 61*a*-61*d* are at rest at a rotation start position, the articles are prevented from falling from the article receiving paths into the upper through-hole 85. This arrangement can therefore prevent the articles from falling from the upper through-hole 85 onto the lower partition wall 83 during standby even if the vending machine is applied with external vibrations.

Figure 9:
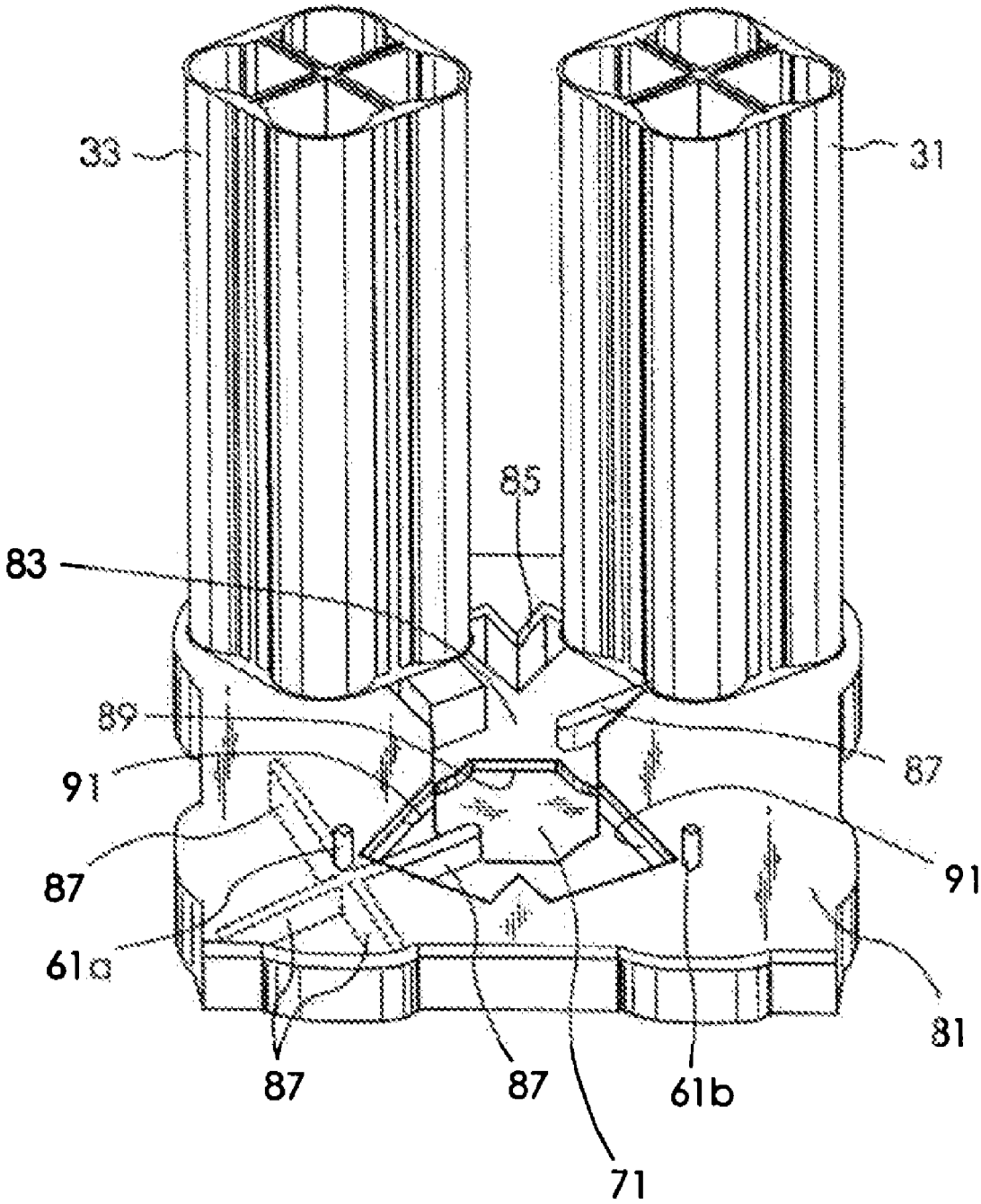
FIG. 9 is a perspective view showing a relation between the article stocker and article moving mechanism.

The second moving mechanism is preferably a rotary moving mechanism. The rotary moving mechanism is disposed between the upper partition wall 81 and the lower partition wall 83 and rotates together with the rotating shafts 61*a*-61*d* to put the article, which has fallen onto the lower partition wall 83, into the guide path 71. More specifically, as best shown in FIG. 6 and FIG. 9, four push plates 87 radially extending 90 degrees apart are secured onto the rotating shafts 61*a*-61*d* to constitute the rotary moving mechanism. The four push plates 87 are arranged to coincide with the separation walls 79*a*-79*d* provided in the article stockers (when seen from above, the four push plates 87 and the separation walls 79*a*-79*d* overlap).

The lower partition wall 83, as shown in FIG. 9, is formed with a lower through-hole 89 that guides an article to the guide path 71. Between the upper partition wall 81 and the lower partition wall 83, it is preferred that guide walls 91 (FIG. 9) to guide the article to the lower through-hole 89 be provided to ensure the article that has fallen onto the lower partition wall 83 should enter into the guide path 71. These guide walls 91 are adapted to allow the push plates 87 to pass therethrough but not to permit the article to pass therethrough. With such guide walls 91, the article that has landed on the lower partition wall 83 can be moved securely to the guide path 71.

In this arrangement, once it falls from the upper through-hole 85 formed in the upper partition wall 81 onto the lower partition wall 83, the article is not affected by the movement of the article stockers. The rotary moving mechanism can also move the article on the lower partition wall 83 into the guide path without being affected by the article stockers located above the upper partition wall 81. Since the article is not affected by the presence of other articles as it is put into the guide path 71, a plurality of articles may get stuck and fail to be dispensed less frequently.

The distance between the upper partition wall 81 and the lower partition wall 83 is determined so that articles situated above the one that has fallen onto the lower partition wall 83 are prevented from entering into the upper through-hole 85 by the presence of the fallen article. In other words, the upper partition wall 81 and the lower partition wall 83 are spaced so that, with one fallen article occupying the space between the upper partition wall 81 and the lower partition wall 83, other stacked articles can slide down from above the fallen one onto the upper partition wall 81. The edge of the upper through-hole 85 is tapered so that the articles situated above the one that has fallen onto the lower partition wall 83 can smoothly slide onto the upper partition wall 81.

The article moving mechanisms 63-69 are provided one for each of four article guiding portions. The upper partition wall 81 and the lower partition wall 83, however, are provided commonly for these article moving mechanisms. In this embodiment, therefore, the arrangement is very simple.

Figure 7:
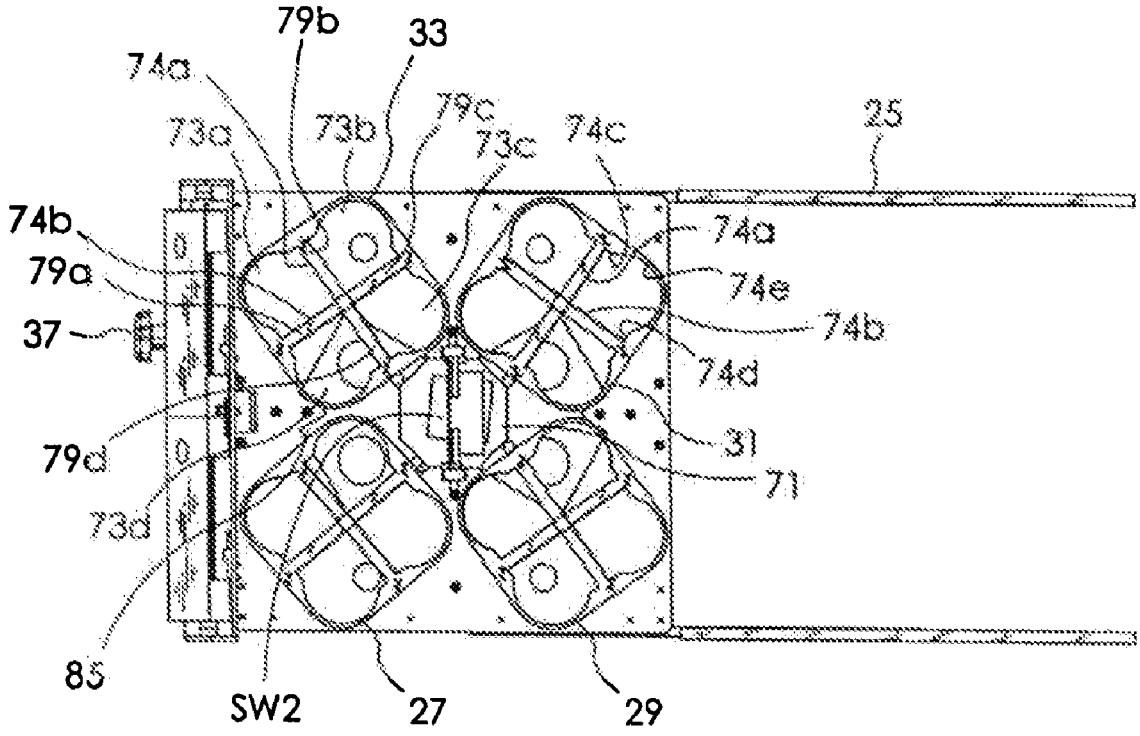
FIG. 7 is a top view of FIG. 2.
Figure 8:
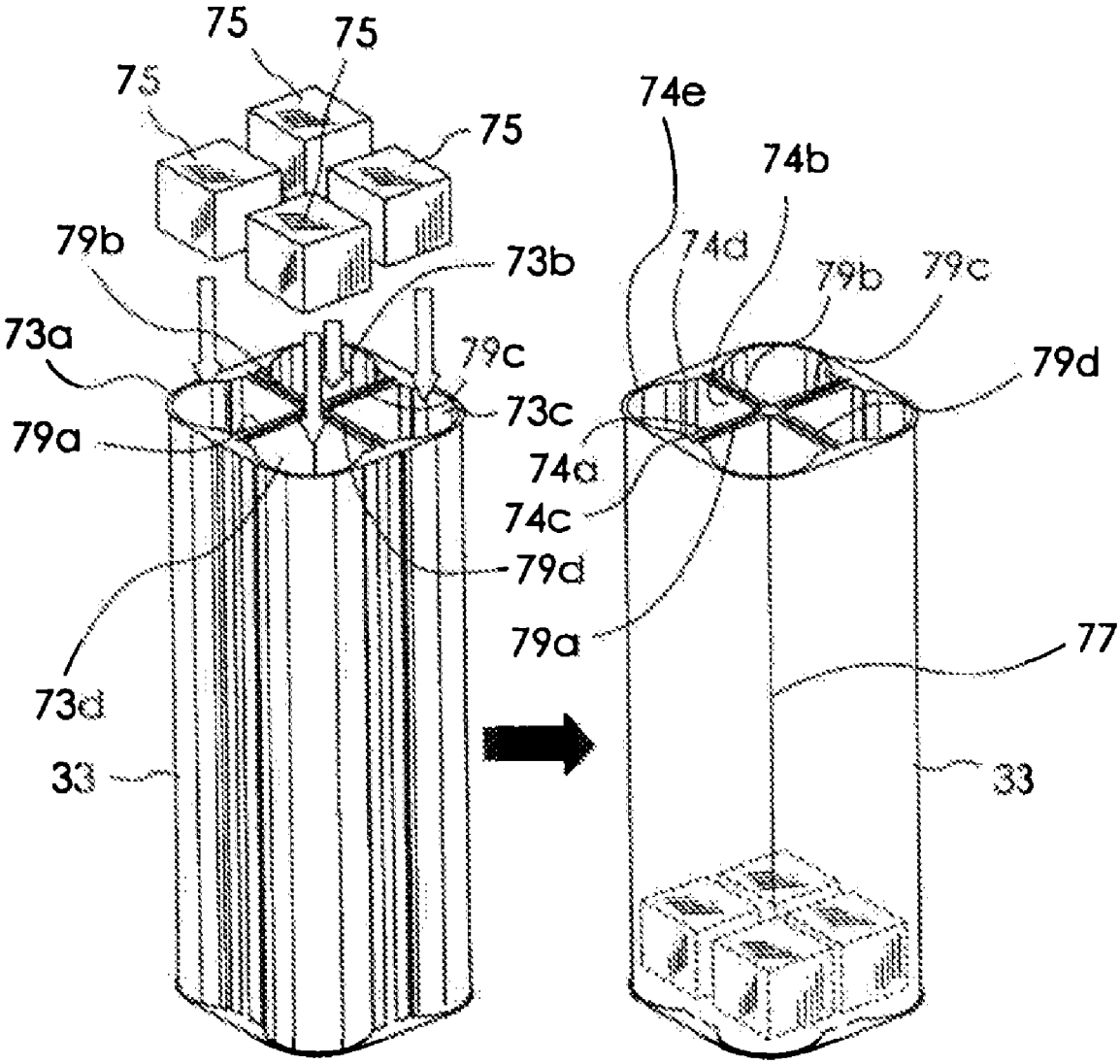
FIG. 8 is a schematic view showing a construction of the article stocker and how articles are stored in the stocker.

As shown in FIG. 7 and FIG. 8, an outline of transverse cross section of each of the article receiving paths 73*a*-73*d* in the article stockers 27-33 of this embodiment has two long sides 74*a*, 74*b* which are longer than one side of the case for the article 75 shown in FIG. 8 and orthogonally crossing each other so that an intersection is formed on a side of the center line, two short sides 74*c*, 74*d* extending from the distal ends of the two long sides 74*a*, 74*b* in directions perpendicular to those of the long sides, and a curved side 74*e* situated outside extensions of the two short sides 74, 74*d* and connecting the two short sides. Determining the transverse cross section of the article receiving paths in this way can prevent the articles from being caught on the inner walls of the article receiving paths even if the article cases tilt inside the paths. This, in turn, effectively prevents the articles from getting stuck in the article receiving paths. With this arrangement, the article receiving paths can receive articles contained in cases of various shapes such as global and oval shapes.

In this embodiment, the article stockers 27-31 are each constructed as a removable unit. As the article stockers 27-31 are moved close to the rotating shafts 61*a*-61*d* of the article moving mechanisms, the article stockers and the article moving mechanisms work in concert with each other. When the article stockers 27-31 are moved away from the rotating shafts 61*a*-61*d* of the moving mechanisms, they no longer work in concert with each other. FIG. 9 shows the article stockers and the rotating shafts, with the article stockers 27 and 29 removed from the view.

Figure 10:
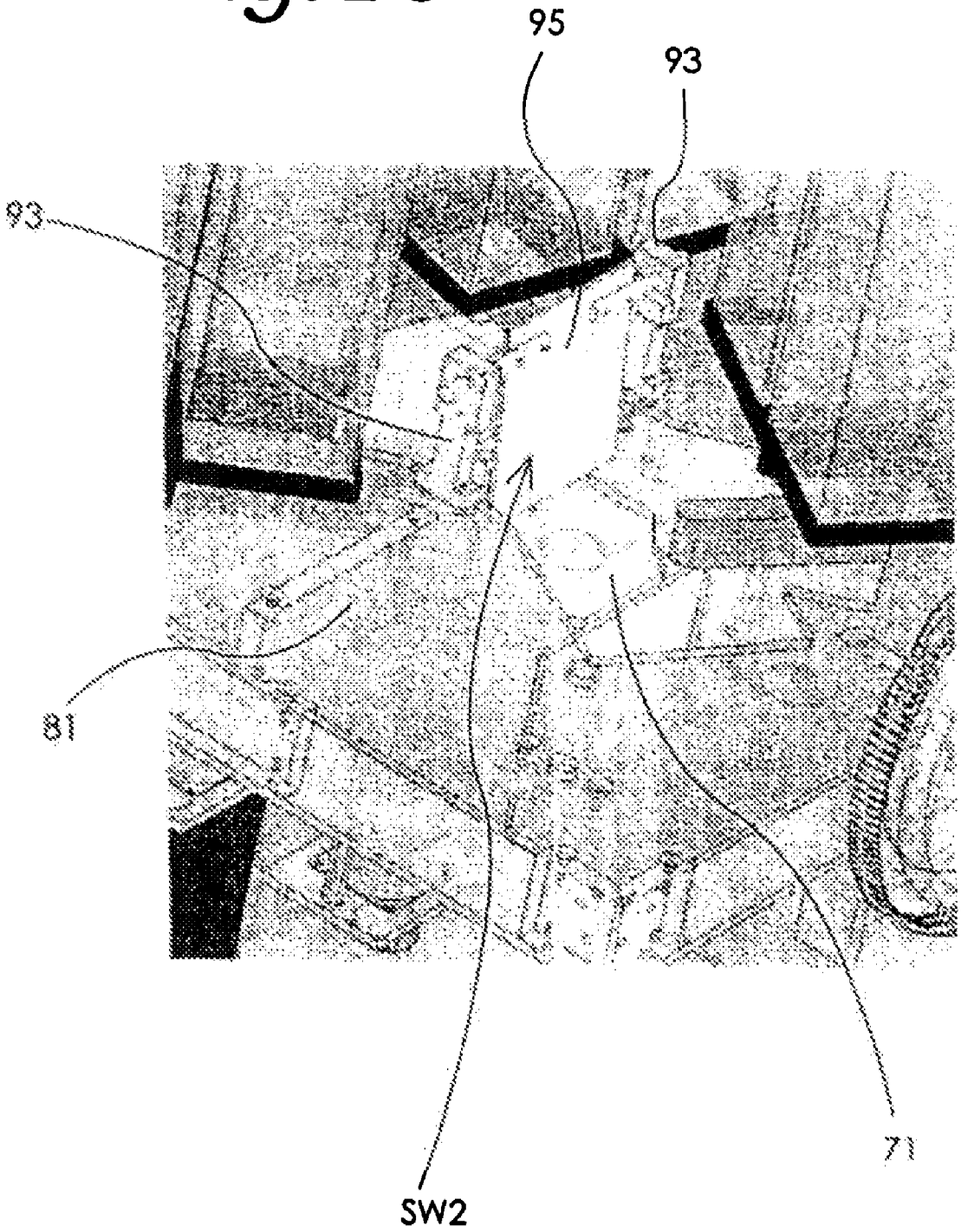
FIG. 10 is a perspective view showing a mounting structure of an article dispensing switch.

As shown in FIG. 7 and FIG. 10, the upper partition wall 81 is provided with an article dispensing check switch SW2 that detects when an article is put into the guide path 71. This switch has a plate 95 mounted onto a support member 93 secured to the upper partition wall 81 in such a manner that the plate can be swung. When the plate 95 is swung by an article as it falls into the guide path 71, a switch not shown turns on or off in response to the motion of the plate 95, detecting that an article is dispensed. Though not shown, each of the article stocker 27-31 is provided with a home position detection switch SW4 (not shown) to detect when each article stocker is at the home position (rotation start or stop position at which the article stockers 27-31 starts rotating in an angular range of 90°). This home position detection switch SW4 may be constructed by a limit switch driven by the separation walls 79*a*-79*d* or the push plates 87.

Figure 11A:
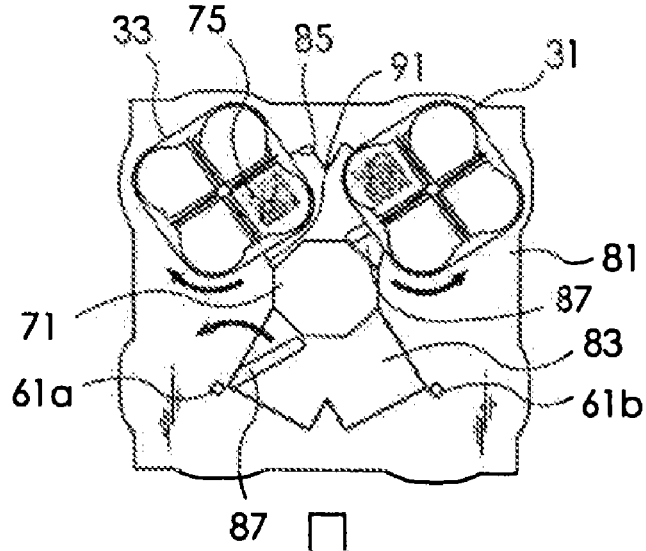
FIGS. 11A to 11C illustrate how the arrangement of this embodiment work.
Figure 11B:
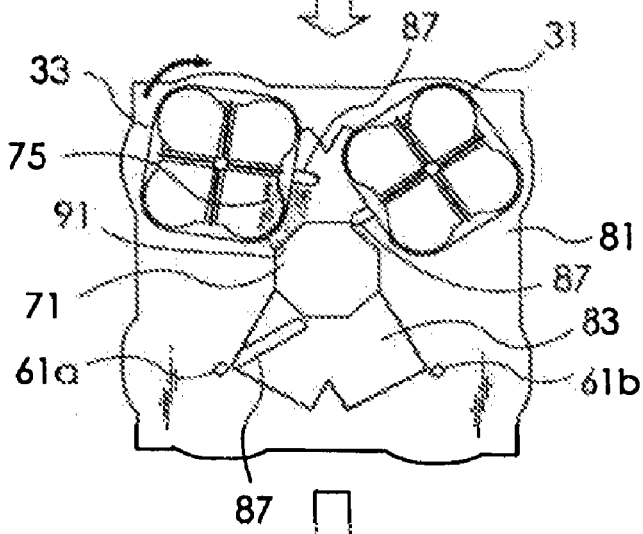
Figure 11C:
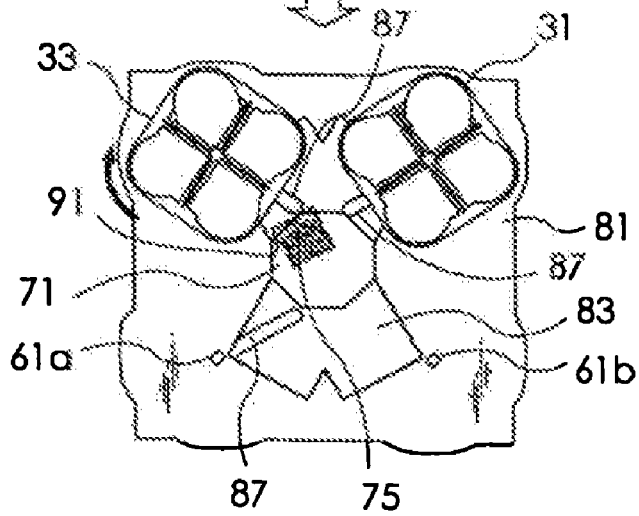
Figure 12:
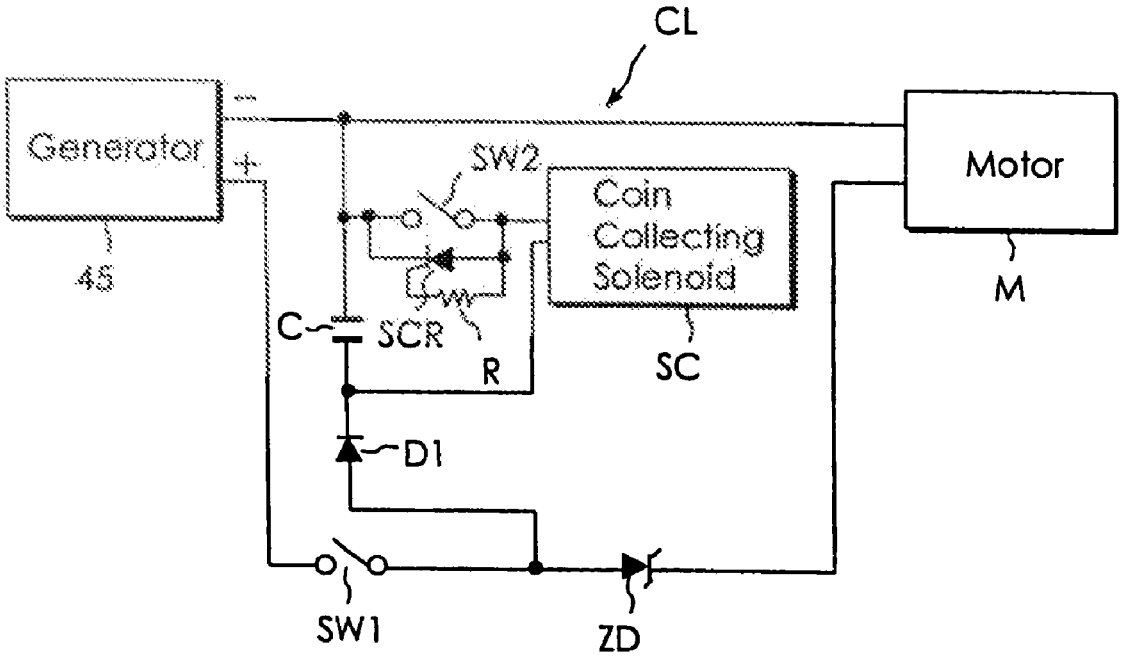
FIG. 12 is a block diagram showing an example control circuit used in the embodiment.

FIG. 11 shows how the above-mentioned arrangement of this embodiment works. FIG. 12 shows an example of a control circuit CL to drive one motor M (generally representing 49-55) by an output of the generator 45. By referring to FIG. 11, the construction and operation of the circuit of FIG. 12 will be explained. The control circuit CL shown in FIG. 12 is provided for each of four motors connected to one generator 45, and thus, in total, four control circuits CL are provided. The output of the generator 45 is supplied to the motor M through a coin insertion check switch SW1 and a Zener diode ZD. The coin insertion check switch SW1 is a normally open switch that is closed when the coin collecting device described later detects that the required number of coins are thrown in. When the generator 45 is started after the coins are thrown in, a voltage is applied to the Zener diode ZD through the switch SW1. At the same time a capacitor C is charged through a diode D. When the voltage applied to the Zener diode ZD exceeds a Zener voltage, the motor M starts. As shown in FIG. 11A, as the motor M rotates to some extent, an article falls from the upper partition wall 81 through the upper through-hole 85 onto the lower partition wall 83 (see FIG. 11A]))). As the motor M rotates further, the article 75 pushed out by the push plate 87 hits the guide wall 91 and is shoved out along the guide wall 91 until the article 75 is thrown into the guide path 71 (see FIG. 11B and FIG. 11C). When the article is pushed out, the article dispensing check switch SW2 installed in the guide path 71 turns on, discharging the electric charges from the capacitor C through a coin collecting solenoid SC and switch SW2. After the article is dispensed, the operation of the manual operation means 9 is stopped, halting the generation operation of the generator 45. At this time, the coin collecting solenoid SC remains energized by the discharging of the capacitor C. Then, the coin collecting solenoid SC causes the coin collecting device to collect the coins. While there are electric charges in the capacitor C, a self-holding circuit composed of a thyristor SCR and a resistor R is operated to have the capacitor C continue discharging. When the capacitor C is completely discharged, the coin collecting solenoid SC is de-energized, terminating the coin collecting operation. With this control circuit CL, electricity can be supplied and controlled only by the output of the generator 45 without having to use a charging means, such as battery, as a power supply for the control circuit.

Figure 13:
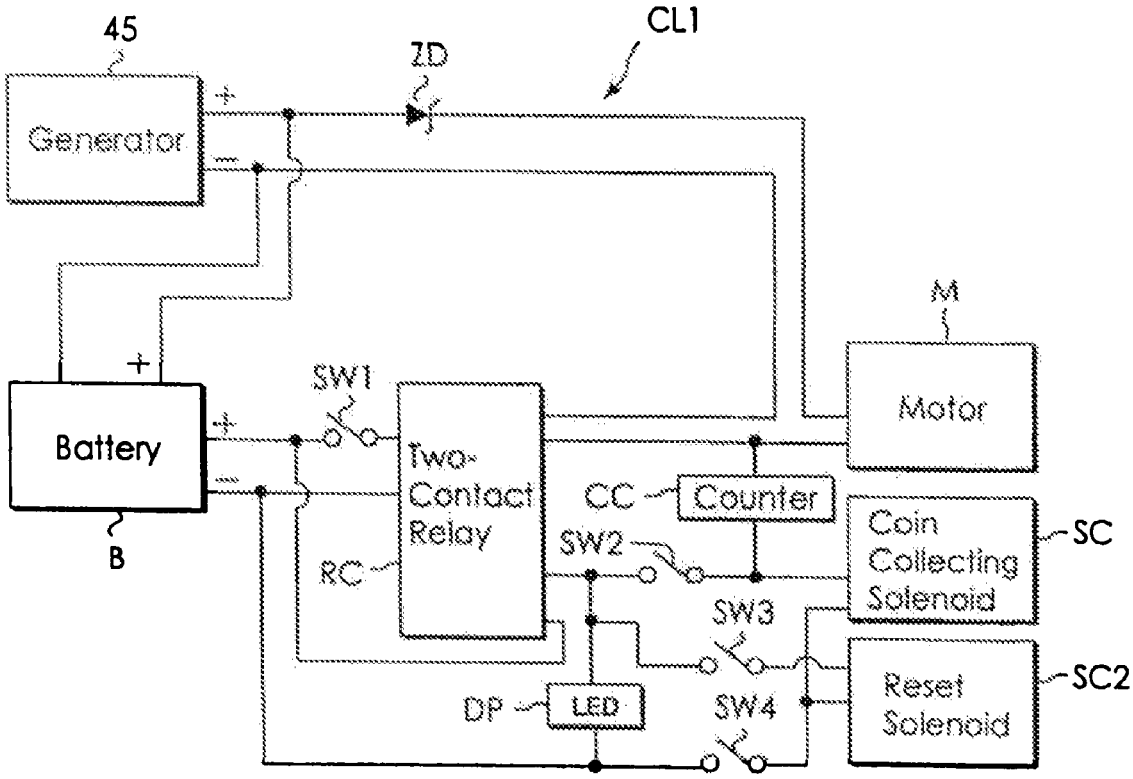
FIG. 13 is a block diagram showing another example of control circuit used in the embodiment.

FIG. 13 shows a configuration of another control circuit CL1. In this control circuit, a battery B as a secondary power supply is charged by the output of the generator 45 and this battery B is used as a control power supply for the control circuit. FIG. 13 omits a charging circuit for the battery B. In FIG. 13, members identical with those shown in FIG. 12 are given the same reference numerals. In this circuit, after the coins are thrown in and the coin insertion check switch SW1 turns on, when the generator 45 is started, the switch SW1 and one of contacts, not shown, of a two-contact relay RC turn on, electrically connecting the motor M and the generator 45 to apply the output voltage of the generator to the Zener diode ZD. When it exceeds the Zener voltage, the output of the generator 45 is supplied to the motor M which then starts rotating. A counter CC counts up each time the motor M is energized. Thus, by looking at the display of the counter CC, the number of times that the article has been dispensed can be checked. This counter CC has a reset function which permits the counter to be reset as required. When the article moving mechanism described later is driven by the rotation of the motor M to dispense an article, the article dispensing check switch SW2 installed in the guide path turns on. As the motor M rotates further and the home position detection switch SW4 turns on, detecting that the article stockers have reached the rotation start position (stocker's origin), the coin collecting solenoid SC is energized. As a result, the operation of the coin collecting solenoid SC causes the coin collecting device to collect coins. When the coin collection is performed by doing an AND operation of the switch SW2 and the switch SW4 as described above, if coins are thrown into a plurality of coin collecting devices simultaneously, only the coin collecting device associated with the article stocker, which has actually dispensed the article, performs the coin collecting operation. Therefore, when coins are thrown into a plurality of coin collecting devices, it is possible to prevent the coins thrown in from being erroneously collected. A switch SW3 is a reset switch that can be operated by a purchaser for resetting. This reset switch SW3 is ANDed with the home position detection switch SW4 to energize a reset solenoid. Thus, the resetting can only be done when the motor is not rotating. Once the motor M begins to turn, the reset operation cannot be executed until the article stocker corresponding to the motor reaches the rotation start position (until an article is dispensed). As described above, in this embodiment, since the coins are collected when the article stocker reaches the rotating start position, the resetting operation is suppressed once the corresponding motor begins rotating. When the switch SW1 is turned on after the required number of coins is thrown in, a display means DP, such as light emitting diode and voice/display means, comes on. When the switch SW1 is turned off, the display means DS goes off. This control circuit CL, as with the control circuit CL1 of FIG. 12, is provided for each article stocker.

Figure 14:
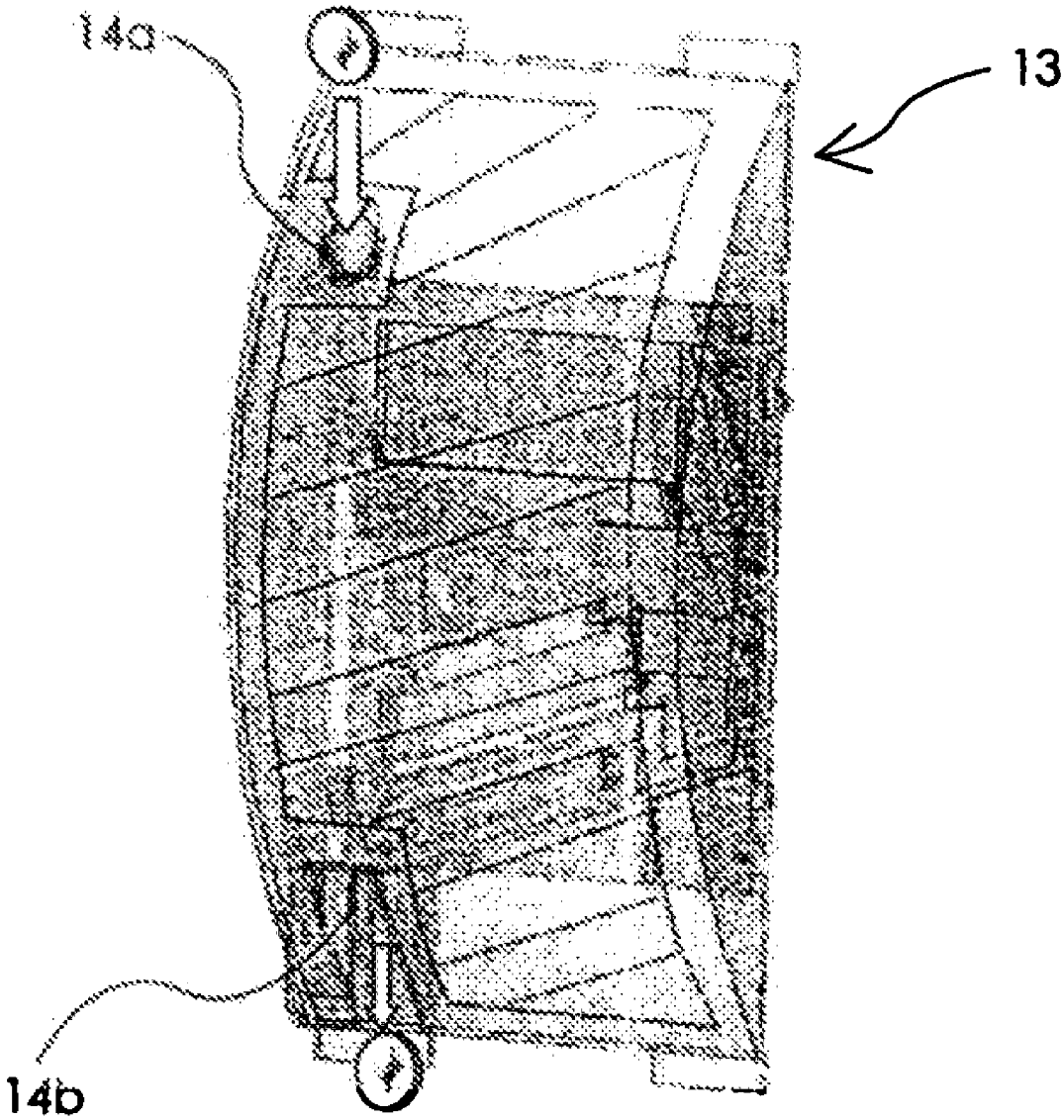
FIG. 14 is an enlarged perspective view showing a coin collecting device container.
Figure 15:
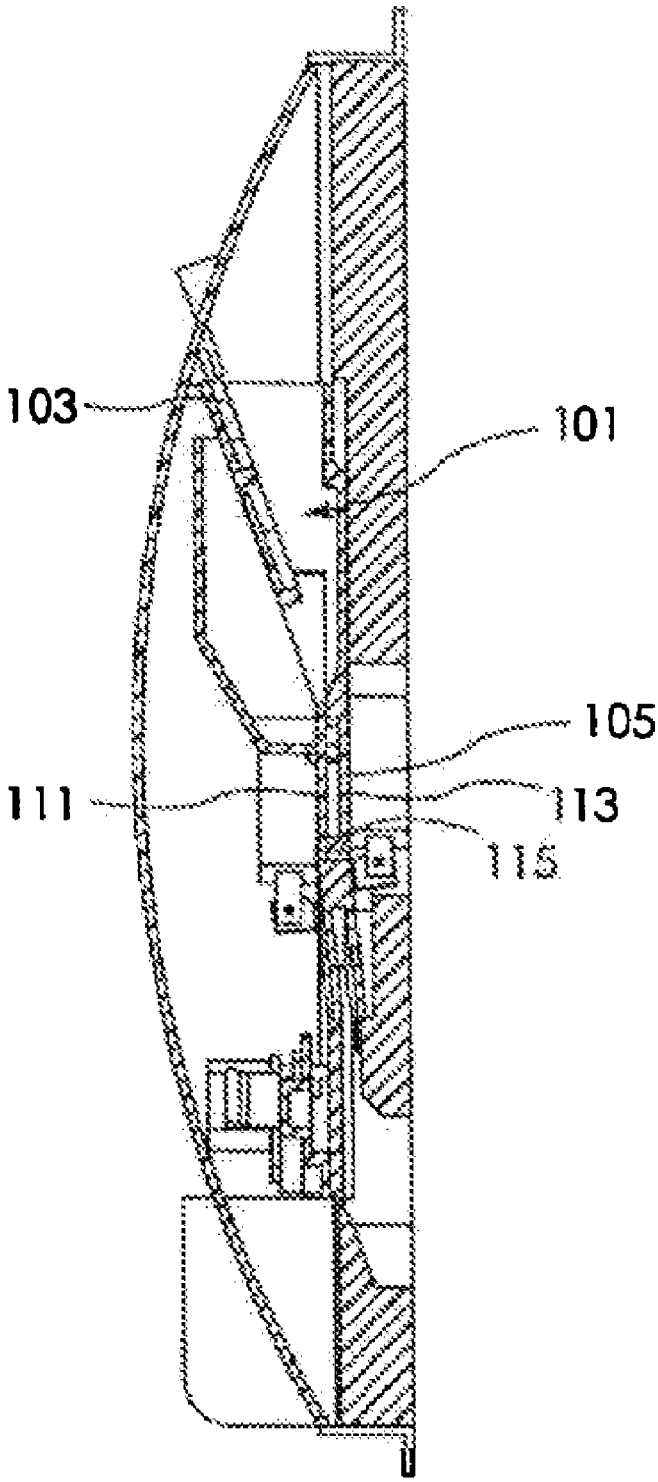
FIG. 15 is a vertical cross-sectional view showing the coin collecting device container.
Figure 16:
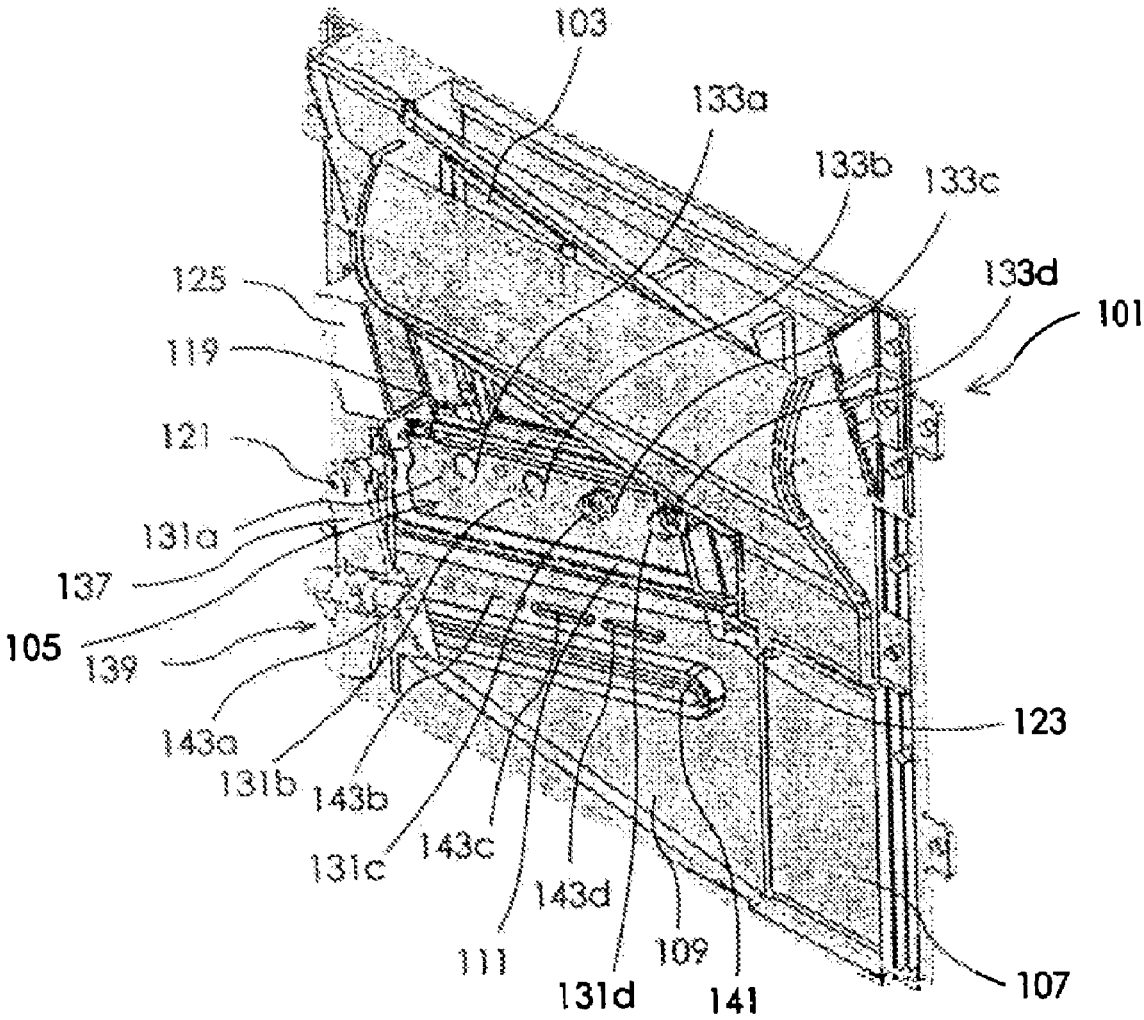
FIG. 16 is a perspective view of the coin collecting device as seen from front upper right.
Figure 17:
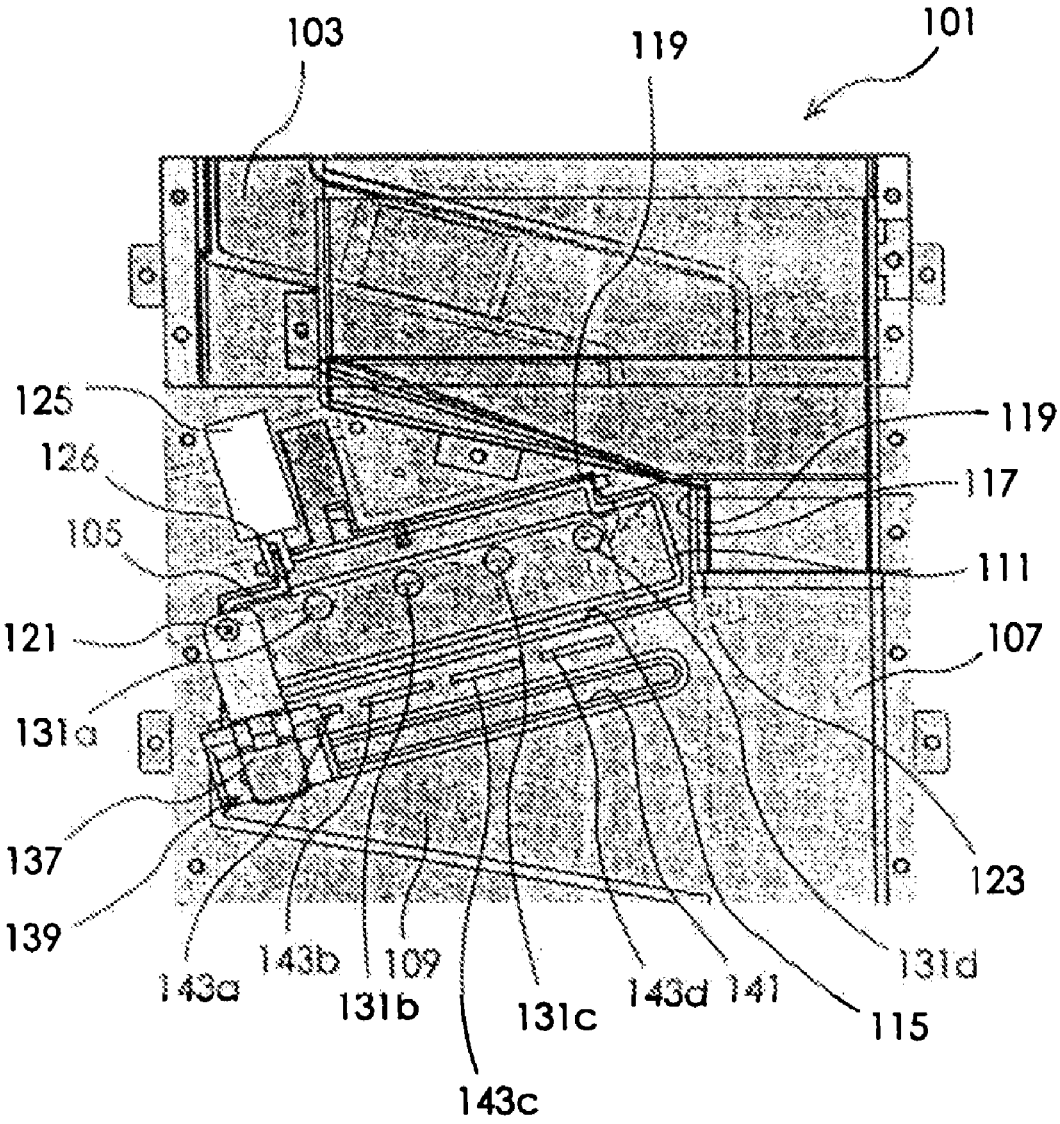
FIG. 17 is a front view of the coin collecting device.
Figure 18:
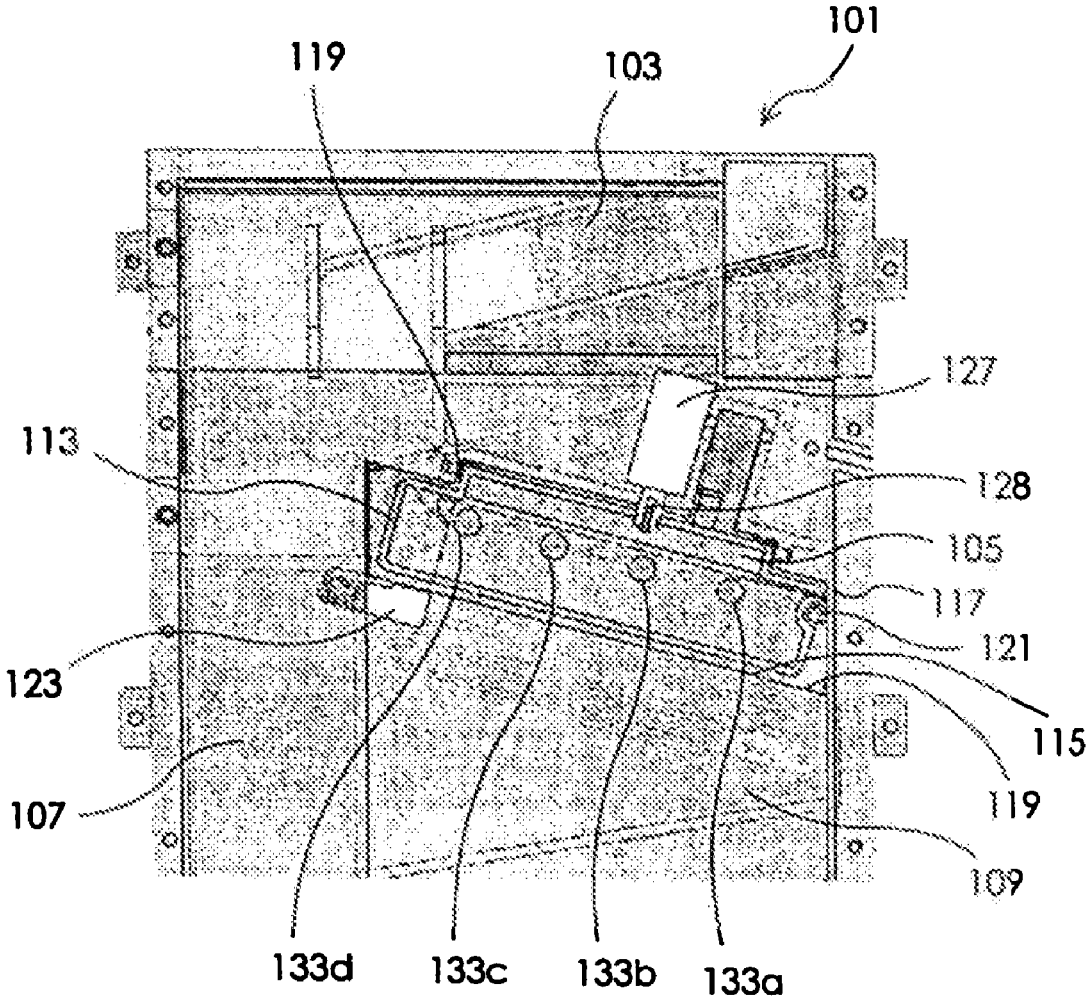
FIG. 18 is a back view of the coin collecting device.
Figure 19:
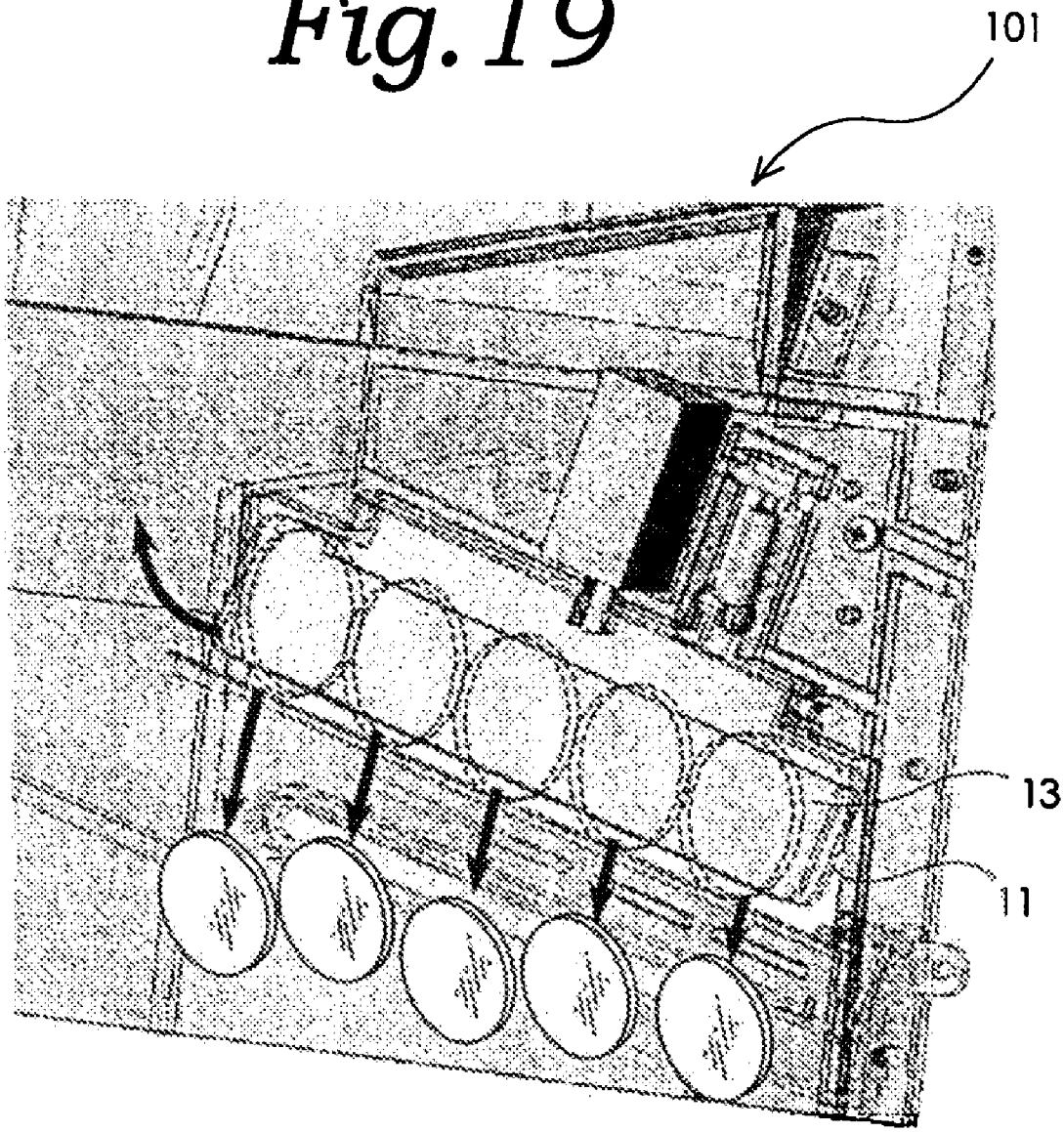
FIG. 19 is a perspective view showing coins as they are collected.

FIG. 14 is an enlarged perspective view of a coin collecting device container 13. In the coin collecting device container 13 is installed a coin collecting device 101 shown in FIG. 15 to FIG. 19. The coin collecting device 101 electrically checks if the necessary number of coins are thrown in. The coin collecting device 101 includes a coin guide 103 to guide coins thrown in from a coin slot 14*a*, a coin holding portion 105 to temporarily hold the coins that have passed the coin guide 103, a coin discharge path 107 (FIG. 16) through which coins have been thrown in more than necessary are discharged to a coin return outlet 14*b*, and a coin collecting path 109 through which to collect the required number of coins that have stayed in the coin holding portion 105. A passage from the coin slot to the coin discharge path 107 constitutes a coin path. In the coin holding portion 105 provided in the coin path, a required number of coins to purchase an article are held in a row.

The coin holding portion 105 is arranged so that one of its ends is situated lower than the other end and that the required number of coins are all held erect (namely, the diameter of the coin runs parallel to a vertical direction) and arranged side by side from one end of the coin holding portion toward the other. This arrangement produces a component of gravity acting on the coins that tends to move the coins downward. Thus, the state of contact between two adjoining coins can be kept in good condition at all times by taking most of the gravity acting on the coins. More specifically, the coin holding portion 105 includes two plate members 111, 113 spaced apart in a thickness direction and a surface 115 opposing a bottom opening of the two plate members 111, 113. The opposing surface 115 is provided by a part of an inner circumferential surface 121 of a large through-hole 119 that is formed in a base body 117 to penetrate the base body in the thickness direction of the base body. When held in the coin holding portion 105, the coins are situated between the two plate members 111, 113 with their outer circumferential portions in contact with the opposing surface 115. The two plate members 111, 113 are arranged so that they can be swung forward and backward relative to their upper edge portions through a hinge mechanism 119.

In this coin collecting device 101, the coin holding portion 105 is constructed so that coins held in line in the coin holding portion 105 are electrically connected in series. A first electrode 121 in contact with a coin situated at one end of the row of coins (at the lower end of the coin holding portion 105) is provided in the coin holding portion. A second electrode 123 in contact with a coin situated at the other end of the coin row (at the higher end of the coin holding portion 105) is also provided in the coin holding portion 105. By checking whether or not an electric current flows between the first electrode 121 and the second electrode 123, it is decided that insertion of the required number of coins is completed. In an example of this decision method, a switch may be used that turns on when electricity flows between the first electrode 121 and the second electrode 123. On the condition that this switch is on, it may be decided that the required number of coins have completely been thrown in. It is also possible to construct the switch by using the first electrode 121, the second electrode 123 and the required number of coins (namely, the required number of coins are used as a movable contact, and the first electrode 121 and the second electrode 123 as a fixed contact).

The first electrode 121 is situated to contact an upper circumferential portion of the coin located at one end (lower end) of the coin holding portion 105, and the second electrode 123 is situated to contact a lower circumferential portion of the coin located at the other end (higher end) of the coin holding portion 105. More specifically, the second electrode 123 has its electrode surface on the opposing surface 115. The first electrode 121 is constructed as a pin-shaped electrode piercing through the two plate members 111, 113. The first electrode 121 of a pin-shaped construction can be used not only as a current detection electrode but also as a stopper for coins entering into the coin holding portion 105. Thus, the first electrode 121 can be used as a means for determining the number of coins required. That is, the first electrode 121 can be changed in its mounting position, being selectively inserted into one of through-holes 131*a*-131*d* of the plate member 111 and one of through-holes 133*a*-133*d* of the plate member 113 (the latter through-holes oppose the through-holes 131*a*-131*d* in the direction of thickness of the plate members 111, 113), thereby constituting a means for determining the number of coins required. In this case, an electrode holding structure 139 having an electrode holder 137 to hold the pin-shaped first electrode 121 is constructed so that, when the two plate members 111, 113 swing toward the coin collecting side, the electrode holder 137 also swings along with the two plate members 111, 113. As described above, the pin-shaped first electrode 121 constitutes a means for determining the number of coins entering between the two plate members. With this arrangement, the first and second electrodes 121, 123 do not hinder the passage of coins entering into the coin holding portion 105. Also when the coins are discharged from the coin holding portion, these electrodes rarely become a hindrance, thus facilitating the structural design.

The coin collecting mechanism that collects coins after discharging or dispensing an article is constructed so that, when the two plate members 111, 113 are swung to one side (in this example, toward the front side), the row of coins is brought out of alignment with the opposing surface 115 to drop down from between the two plate members 111, 113 into a coin box not shown. This construction allows the coins to fall and be collected securely only by the swing operation of the two plate members.

To realize the swing operation of the two plate members 111, 113, two solenoids (electromagnetically energized operation mechanisms) 125, 127 are arranged on both sides of the two plate members 111, 113. The solenoid 125 installed on the front side (on the side of the plate member 111) is a coin collecting solenoid, and the solenoid 127 installed on the rear side (on the plate member 113 side) is a reset solenoid. When the solenoid 125 is energized to pull up a piston member 126, the two plate members 111, 113 swing toward the front side. A connecting structure between a piston member 128 of the other solenoid 127 and the plate member 113 is constructed to cause the plate member 113 to swing rearward when the piston member 128 is pulled up. However, when the plate member 113 is swung forward, the connecting structure allows its swinging operation. If the purchaser wants the inserted coins returned and the solenoid 127 is energized, the piston member 128 of the solenoid 127 is pulled up to cause the two plate members 111, 113 to swing rearward. A connecting structure between the piston member 126 of the solenoid 125 and the plate member 111 is constructed to cause the plate member 111 to swing to the front side when the piston member 126 is pulled up. But when the plate member 111 is swung rearward, the connecting structure allows its swinging operation.

In this embodiment, to use the first electrode 121 as a means for determining the required number of coins, the base body 117 provided with the opposing surface 115 is formed with a slide groove 141 disposed below, and extending parallel to, the opposing surface 115. In the slide groove 141, a part of the electrode holding structure 139 is slidably fitted. Further, between the slide groove 141 and the opposing surface 115, a plurality of positioning grooves or recesses 143*a*-

143*d* are formed to extend at intervals along the slide groove 141. The electrode holding structure 139 is provided with a positioning portion (not shown) which is engaged in the positioning groove or recess 143*a*-143*d*. With this arrangement, simply sliding the electrode holding structure 139 along the slide groove 141 and fitting the positioning portion of the electrode holding structure 139 into one of the positioning grooves or recesses 143*a*-143*d* can easily position and secure the electrode.

In the coin collecting device 101, since an electric current does not flow between the first electrode 121 and the second electrode 123 through the coins unless the required number of coins exist in line in the coin holding portion 105, it is possible to easily and reliably decide when the required number of coins have been inserted. Particularly, when there is a forged coin made of other than a metal among the inserted coins, electric current does not flow. So, it is also possible to check if forged coins are thrown in. If the forged coins inserted are made of metal and a resistance of the forged coin metal differs from that of the genuine coins, a current value flowing between the first electrode and the second electrode (or an overall resistance) also differs. Therefore, measuring the current value (resistance value) can determine whether or not any forged metal coins are included in the coins thrown in.

Referring to the circuits of FIG. 12 and FIG. 13, a switch SW1 is an equivalent of the coin insertion completion detection means.

INDUSTRIAL APPLICABILITY

According to the present invention, unless the required number of coins have been held or aligned in the coin holding portion, the electric current does not flow between the first second electrodes via the coins. Therefore, it can be determined whether or not insertion of the required number of coins for purchasing an article is completed. Particularly, when a non-metal forged coin is included in the inserted coins, the electric current does not flow. Therefore, the method of the present invention has such an advantage that it is possible to determine whether or not a forged coin is inserted at the same time as whether or not coin insertion is completed. Also, when a forged coin is inserted, if the resistance value of the forged coin is different from that of the genuine coin, the value of the electric current that flows between the first and second electrodes (or the entire resistance value) varies. Thus, it is possible to determine whether or not a forged metal coin is included in the inserted coins by measuring the current value (resistance value).

The invention claimed is:

1. A coin collecting device for a vending machine comprising:

a collecting device body that includes a coin path having a coin holding portion where a required number of coins for purchasing an article are held in a row;

a coin-insertion completion determining means that determines whether or not the required number of coins have been inserted into the coin holding portion; and a coin collecting mechanism that operates in concert with a dispensing operation of an article to move the coins from the coin holding portion into a coin box, the coin holding portion being constructed so that the coins held in a row therein are electrically connected to each other in series, the coin-insertion completion determining means including a first electrode that is in contact with the coin located at one end of the row and a second electrode that is in contact with the coin located at the other end of the row, and being constructed to detect that the insertion of the required number of coins has been completed by detecting an electric current flowing between the first and second electrodes, the coin holding portion being constructed in such a manner that the one end of the row is positioned lower than the other end of the row, and that the required number of coins are all held erect and side by side from the one end toward the other end, the coin holding portion including two plate members spaced apart in a thickness direction and an opposing surface opposing a bottom opening of a space formed between the two plate members, and is constructed so that the coins are held between the two plate members with outer peripheral portions thereof being in contact with the opposing surface, both upper end portions of the two plate members being disposed to be able to swing via a hinge mechanism such that the first electrode swings with the two plate members, and the coin collecting mechanism being constructed so that, when the two plate members are swung to one side, the coins of the row get out of contact with the opposing surface to drop down from between the two plate members into a coin box.

2. The coin collecting device for a vending machine according to claim 1, wherein the first and second electrodes are constructed in such a manner that an installation position of at least one of the first and second electrodes is movable.

3. The coin collecting device for a vending machine according to claim 1, wherein the first electrode is constructed to be in contact with an upper peripheral portion of the coin located at the one end of the row held in the coin holding portion; and the second electrode is constructed to be in contact with a lower peripheral portion of the coin located at the other end of the row held in the coin holding portion.

4. The coin collecting device for a vending machine according to claim 1, wherein the second electrode is disposed on the opposing surface; and the first electrode is constructed as a pin-shaped electrode piercing through the two plate members.

5. The coin collecting device for a vending machine according to claim 4, wherein the installation position of the first electrode is constructed to be movable;

an electrode holding structure includes an electrode holder that holds the pin-shaped electrode, and is constructed so that, when the two plate members swing toward the coin collecting side where the coins are collected, the electrode holder also swings along with the two plate members; and the pin-shaped electrode constitutes a means for determining the number of the coins entering between the two plate members.

6. The coin collecting device for a vending machine according to claim 5, wherein a base body provided with the opposing surface is formed with a slide groove disposed below, and extending parallel to, the opposing surface;

a part of the electrode holding structure is slidably fitted in the slide groove;

a plurality of positioning grooves or recesses are formed at intervals along the slide groove between the slide groove and the opposing surface; and the electrode holding structure is provided with a positioning portion to be fitted in the positioning grooves or recesses.

* * * * *